US009212847B2

(12) United States Patent
Min et al.

(10) Patent No.: US 9,212,847 B2
(45) Date of Patent: Dec. 15, 2015

(54) REFRIGERATOR HAVING VEGETABLE STORAGE CONTAINER

(71) Applicant: LG Electronics Inc., Seoul (KR)

(72) Inventors: Deulre Min, Seoul (KR); Ahreum Park, Seoul (KR); Kyongbae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/718,813

(22) Filed: May 21, 2015

(65) Prior Publication Data

US 2015/0253065 A1 Sep. 10, 2015

Related U.S. Application Data

(63) Continuation of application No. 13/862,958, filed on Apr. 15, 2013, now Pat. No. 9,073,670.

(30) Foreign Application Priority Data

Apr. 16, 2012 (KR) ..... 10-2012-0039390

(51) Int. Cl.

| | |
|---|---|
| ***A47B 96/04*** | (2006.01) |
| ***F25D 25/02*** | (2006.01) |
| ***F25D 23/12*** | (2006.01) |

(52) U.S. Cl.

CPC ..... *F25D 25/025* (2013.01); *F25D 23/12* (2013.01); *F25D 25/028* (2013.01); *F25D 2201/10* (2013.01); *F25D 2300/00* (2013.01); *F25D 2400/00* (2013.01); *F25D 2600/04* (2013.01)

(58) Field of Classification Search

CPC ..... F25D 25/025; F25D 23/12; F25D 25/028; A47B 2210/17; A47B 2210/175; A47B 2210/19; A47B 88/08; E05B 65/46; B65D 25/22

USPC ..... 312/402, 404, 332.1, 215, 222, 333, 312/296; 62/449

See application file for complete search history.

(56) References Cited

U.S. PATENT DOCUMENTS

| | | | |
|---|---|---|---|
| 3,120,412 | A | 2/1964 | Caldwell |
| 5,329,865 | A | 7/1994 | McWard |
| 5,379,184 | A | 1/1995 | Barraza et al. |
| 6,231,144 | B1 | 5/2001 | Chen et al. |
| 6,351,379 | B1 | 2/2002 | Cheng |
| 6,953,232 | B2 | 10/2005 | Busby |
| 2003/0117048 | A1 | 6/2003 | Mueller |
| 2004/0060319 | A1 | 4/2004 | Wood |
| 2004/0065579 | A1 | 4/2004 | Wood |
| 2005/0150082 | A1 | 7/2005 | Shih |

(Continued)

*Primary Examiner* — Hanh V Tran

(74) *Attorney, Agent, or Firm* — Dentons US LLP

(57) ABSTRACT

This specification relates to a vegetable storage container for a refrigerator, and more particularly, a sealing structure of a vegetable storage container for a refrigerator capable of sealing an inside of an accommodation space of a vegetable box simply by using a lever after closing the accommodation space with a cover. This specification provides a refrigerator with a vegetable storage container, which includes a vegetable box having a front part and a main body both forming an accommodation space therein as a storage space for vegetables, the vegetable box being installed to be drawn out of the refrigerator, a vegetable box cover horizontally installed on the accommodation space to selectively cover an upper opening of the vegetable box, and a pressing unit to seal the accommodation space after the accommodation space of the vegetable box is closed by the vegetable box cover.

15 Claims, 8 Drawing Sheets

(56) References Cited

U.S. PATENT DOCUMENTS

| | | | | |
|---|---|---|---|---|
| 2005/0172657 | A1 | 8/2005 | Hwang | |
| 2005/0236944 | A1 | 10/2005 | Nakayama | |
| 2007/0234754 | A1 | 10/2007 | Pimputkar et al. | |
| 2008/0019036 | A1* | 1/2008 | Chu et al. | 360/97.01 |
| 2008/0302441 | A1* | 12/2008 | Kelly et al. | 141/65 |
| 2010/0090575 | A1* | 4/2010 | Uthuppan | 312/404 |
| 2010/0251754 | A1* | 10/2010 | Lim et al. | 62/455 |
| 2011/0023530 | A1* | 2/2011 | An et al. | 62/449 |
| 2011/0101018 | A1* | 5/2011 | Shafir | 221/1 |
| 2011/0289957 | A1* | 12/2011 | Kim et al. | 62/404 |
| 2012/0126680 | A1* | 5/2012 | Lee et al. | 312/408 |

* cited by examiner

REFRIGERATOR HAVING VEGETABLE STORAGE CONTAINER

CROSS-REFERENCE TO RELATED APPLICATION

This application is a continuation application of Ser. No. 13/862,958, filed Apr. 15, 2013, now allowed, which claims the benefit of Korean Application No. 10-2012-0039390, filed on Apr. 16, 2012, the contents of which is incorporated by reference herein in its entirety.

BACKGROUND OF THE INVENTION

1. Field of the Invention

This specification relates to a refrigerator having a vegetable storage container, and particularly, to a hermetic structure of a vegetable storage container for a refrigerator capable of sealing an inner accommodation space of a vegetable box.

2. Background of the Invention

In general, a refrigerator is equipment for keeping food stuffs in a cold state for a long term of time by generating cold air by way of driving a refrigerating cycle installed in the refrigerator and supplying the cold air into a refrigerating chamber and a freezing chamber.

The refrigerator may include a vegetable container for keeping vegetables. When the vegetables are kept in the refrigerator, they should be maintained as fresh as possible. Therefore, it may be important to maintain the space for storing the vegetables in an optimal condition.

FIGS. 1 to 3 show main parts of a vegetable container for a refrigerator according to the related art, which are a perspective view and coupled views of a sealing structure of the vegetable container for the refrigerator according to the related art.

Referring to FIG. 1, the related art vegetable container may include a vegetable box 200 having an accommodation space having an upper opening for storing vegetables therein, and a cover 100 for covering the upper opening of the vegetable box 200.

The cover 100 may include an inner cover 120 having cover gaskets 123 for sealing the upper opening of the vegetable box 200, and an outer cover 110 located on the inner cover 120.

The vegetable box 200 may include a main body 210 defining the accommodation space for the vegetables therein, and a front part 230 having a front panel 231 formed thereon.

The cover 200, as shown in FIG. 2, may be pushed in a slidable manner to close the upper opening of the accommodation space of the vegetable box 200.

Especially, cover rails 113 may be disposed long in back and forth directions on both sides of a lower surface of the outer cover 110 of the cover 100. The cover rails 113 of the outer cover 110 and main body rails 211, which are disposed on both sides of an upper surface of the main body 210, may be mutually slidable to open or close the inner accommodation space of the vegetable box 200.

Referring to FIG. 3, the cover 100 may be closed in a manner that stopping protrusions 1131 of the outer cover 110 are engaged with protrusions 2111 formed on end portions of the rails 211 on the upper surface of the main body 210 such that the cover 100 cannot be slid.

Accordingly, when the cover 100 is closed with sealing the upper opening of the vegetable box 200, the cover gaskets 123 may be pressed due to the weight of the cover 100, thereby realizing a sealing function.

However, the vegetable box for the refrigerator according to the related art may have the following problems.

Referring to FIG. 3, the related art vegetable box cover 100 may cover the upper opening of the vegetable box 200 in the sliding manner. However, without a force applied upwardly, the cover 100 and the vegetable box 200 may be separated from each other by a predetermined gap at a gasket-loosed portion S. This may make it difficult to completely engage the cover gaskets with the vegetable box, and accordingly a gap may be generated. Also, the accommodation space of the vegetable box 200 may not be completely sealed by the cover 100.

Consequently, odors of food stuffs stored in the refrigerating chamber or the freezing chamber of the refrigerator may permeate vegetables stored in the inner accommodation space of the vegetable box 200 via the gasket-loosed portion S. Also, the accommodation space of the vegetable box 200 may not be maintained with proper humidity, and accordingly the vegetables may not be kept in a fresh state.

Also, due to the loosed gap, the vegetable box may not be sealed depending on a user's usage pattern. Accordingly, a sealing force shortage may be caused and the vegetables may be caught.

SUMMARY OF THE INVENTION

Therefore, to overcome those drawbacks of the related art, an aspect of the detailed description is to provide a refrigerator having a vegetable storage container having an improved sealing force.

Another aspect of the detailed description is to provide a refrigerator having a vegetable storage container, capable of improving a sealing force of a cover gasket according to movement of a lever, which is further employed and perpendicularly movable by a force forcibly applied by a user.

Another aspect of the detailed description is to provide a vegetable container for a refrigerator, capable of firmly maintaining a sealing force after closing a cover in a sliding manner, by varying a structure and a shape for improving a sealing force for a vegetable box.

The present disclosure may be implemented by the exemplary embodiments with the following configurations as preferred configurations to achieve the above aspects. The present disclosure provides the following technical configurations to realize the above objects.

To achieve these and other advantages and in accordance with the purpose of this specification, as embodied and broadly described herein, there is provided a refrigerator comprising a vegetable storage container, wherein the vegetable storage container may include a vegetable box having a front part and a main body both forming an accommodation space therein as a storage space for vegetables, the vegetable box being installed to be drawn out of the refrigerator, a vegetable box cover horizontally installed on the accommodation space to selectively cover an upper opening of the vegetable box, and a pressing unit to seal the accommodation space after the accommodation space of the vegetable box is closed by the vegetable box cover.

The pressing unit may include a lever installed to protrude from the front part of the vegetable box to press the vegetable box cover by a user's manipulation, and pressing portions installed on both side portions of the vegetable box cover to seal the accommodation space by interworking with the lever after the vegetable box is closed by the vegetable box cover.

The lever may include a handle installed with being spaced apart from the front part, supports supporting the handle and rotatable on a hinge basis, and pressing protrusions protruding from end portions of the respective supports in a lateral direction.

The front part of the vegetable box may include slots cut off in a lengthwise direction thereof, and the supports may be inserted through the slots to be located on outer sides of the main body of the vegetable box.

As another exemplary embodiment of the present disclosure, the front part of the vegetable box may include a front panel located at the front of the accommodation space, and side frames formed on both sides of the front panel and having the slots cut off in the lengthwise direction thereof. Here, the supports may be inserted through the slots to be located on outer sides of the main body.

The front part of the vegetable box may include main body hinge portions formed on both sides thereof to allow for hinge-based rotation of the lever, and the lever may include lever hinge portions formed on the supports and fixed to the main body hinge shafts. Here, the vegetable box cover may include pressing protrusion insertion portions through which the pressing protrusions are inserted in the pressing portions.

Each of the pressing protrusions may include a pressing roller rolled on the pressing portion formed on the vegetable box cover to press the pressing portion.

As another exemplary embodiment of the present disclosure, each of the pressing portions may include a supporting shaft protruding in a lateral direction of the vegetable box, and a plate onto which the pressing protrusion is rolled based on the supporting shaft. The plate may be curved upwardly. Here, the supporting shaft and the plate may be formed integrally with each other or as separate members.

As another exemplary embodiment of the present disclosure, each of the pressing portions may include a tilt rail formed on a side portion of the cover in an inclined direction, the pressing protrusion of the lever being inserted into the tilt rail.

As another exemplary embodiment of the present disclosure, the vegetable box cover may include a rear sealing support portion in a bent form, and the main body of the vegetable box may include a protrusion rib protruding backwardly such that the rear sealing support portion is stopped therein.

The vegetable box cover may include an inner cover having cover gaskets to seal the accommodation space, and an outer cover located on the inner cover, and the pressing unit may press the outer cover.

The pressing unit may include a lever provided with a handle protruding from the front part of the vegetable box with being spaced therefrom, supports supporting the handle and rotatable on a hinge basis, and pressing protrusions protruding from end portions of the respective supports in a lateral direction, the lever pressing the outer cover by a user's manipulation, and pressing portions installed on both sides of the outer cover to seal the accommodation space by interworking with the lever after the vegetable box cover is closed.

The outer cover may include a rear sealing support portion in a bent form, and the main body of the vegetable box may include a protrusion rib protruding backwardly such that the rear sealing support portion is stopped therein.

As described above, the present disclosure may acquire the following effects by the aforementioned solutions and configuration and coupling and operation relations to be explained later.

In accordance with one exemplary embodiment, a lever which is manually operated by a user's manipulation may further be employed to enhance sealing of gaskets in response to movement of the lever.

Also, with changes in structure and shape of gaskets disposed at the rear of a vegetable box for enhancing the sealing force of the gaskets, the sealing force may be firmly maintained after closing a vegetable box cover in a sliding manner.

Also, when the vegetable box is accommodated within the vegetable storage container, an accommodation space of the vegetable box may be firmly sealed by the vegetable box cover. This may prevent odors of other food stuffs, stored in storage spaces of the refrigerator, from permeating vegetables or other food stuffs stored in the accommodation space of the vegetable box, and also mallow humidity of the accommodation space to be suitably maintained, resulting in keeping such food stuffs in a fresh state.

Also, with preventing generation of a loosed gap between the vegetable box and the vegetable box cover, a problem that vegetables are stuck in the loosed gap, upon keeping the vegetables in the refrigerator, due to a user's usage pattern.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
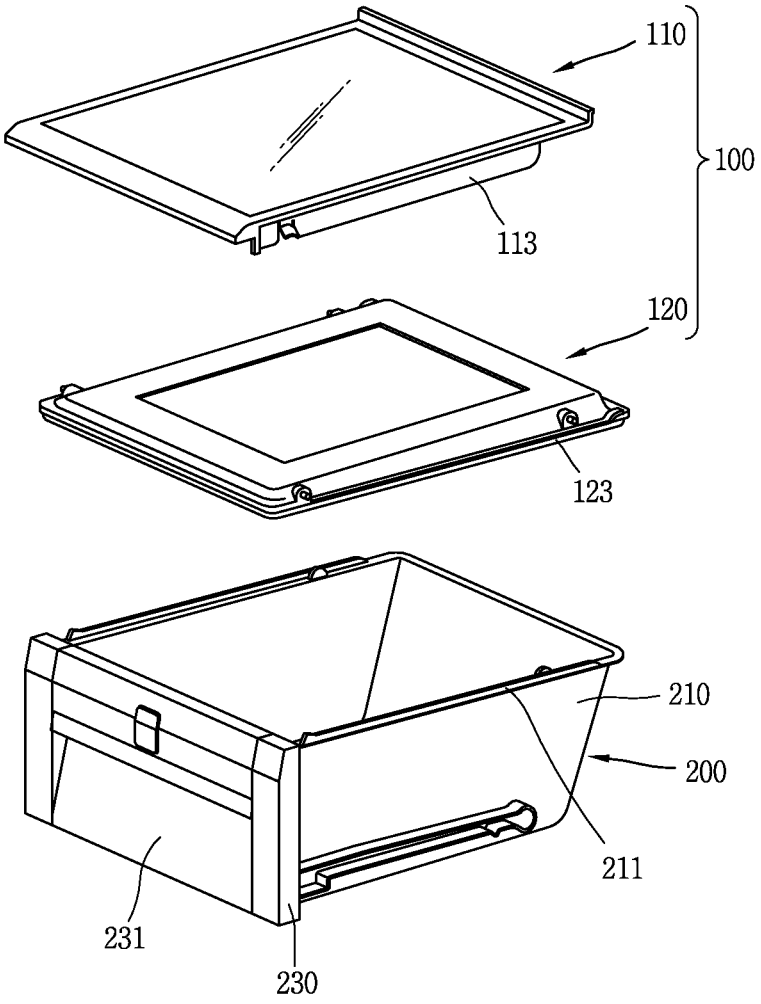
FIG. 1 PRIOR ART
FIG. 1 is a disassembled perspective view of a vegetable storage container for a refrigerator according to the related art.
Figure 2:
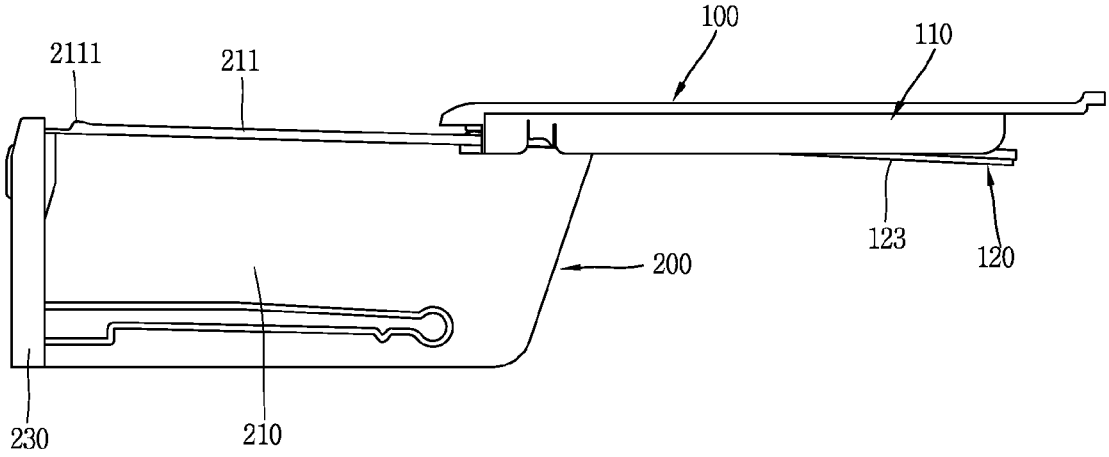
FIG. 2 PRIOR ART
FIG. 2 is a side view of the vegetable storage container shown in FIG. 1.
Figure 3:
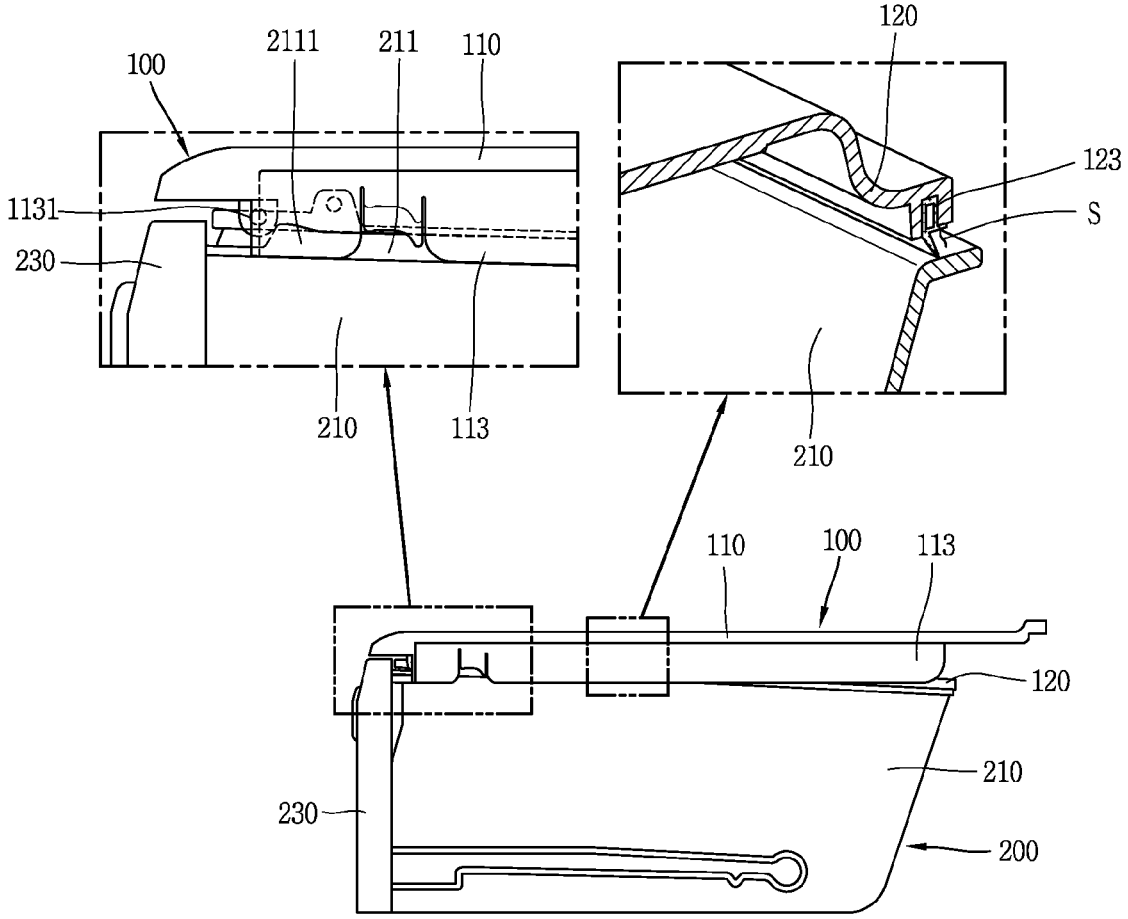
FIG. 3 PRIOR ART
FIG. 3 is a partially enlarged view of the vegetable storage container shown in FIG. 1.

Description will now be given in detail of a vegetable container for a refrigerator and a refrigerator having the same according to the exemplary embodiments, with reference to the accompanying drawings.

Terms or words used in this specification and the claims should not be construed as being limited to typical or dictionary definition, but be understood as meaning and conception that come within the technical scope of the present disclosure based on a principle that the inventor is able to appropriately define the conception of terms for describing his invention by the best way.

Therefore, the preferred embodiments described herein and configurations shown in the drawings are merely illustrative and should not be construed to limit the spirit of the invention. Therefore, it should be understood that there can be various equivalents and variations which can substitute the preferred embodiments at the time point of filing this application.

Figure 4:
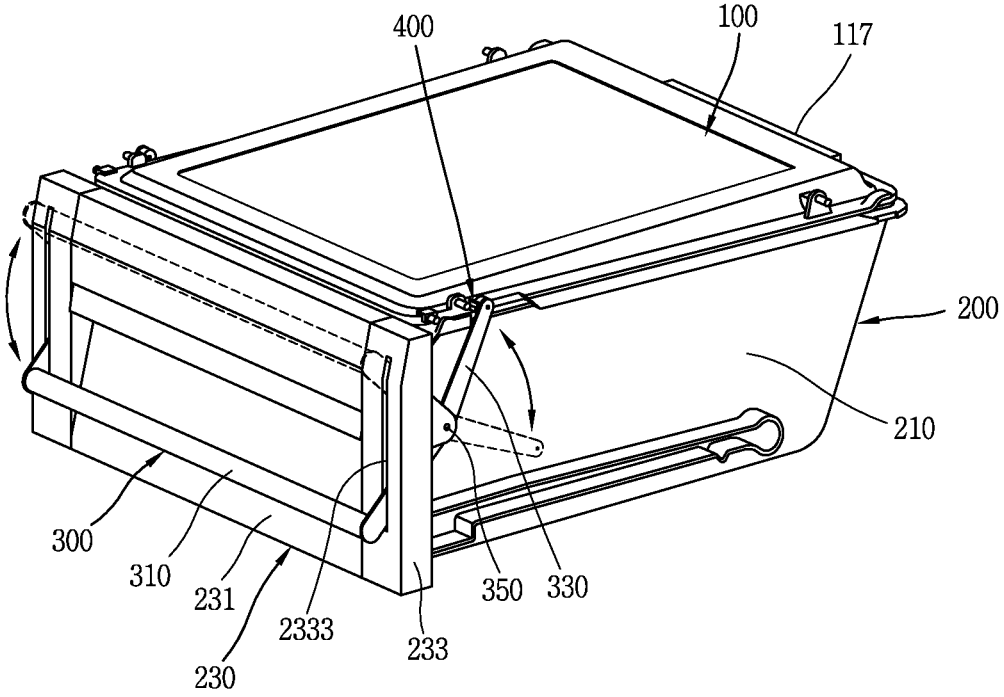
FIG. 4 is a perspective view of a vegetable storage container for a refrigerator in accordance with one exemplary embodiment of the present disclosure.
Figure 5:
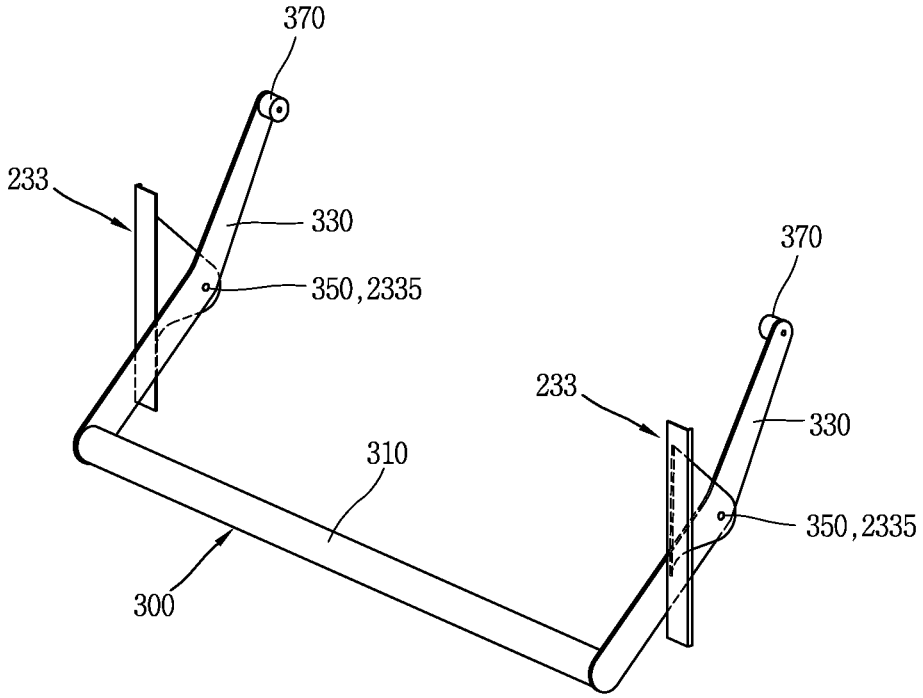
FIG. 5 is a perspective view showing a lever in accordance with the one exemplary embodiment.
Figure 6:
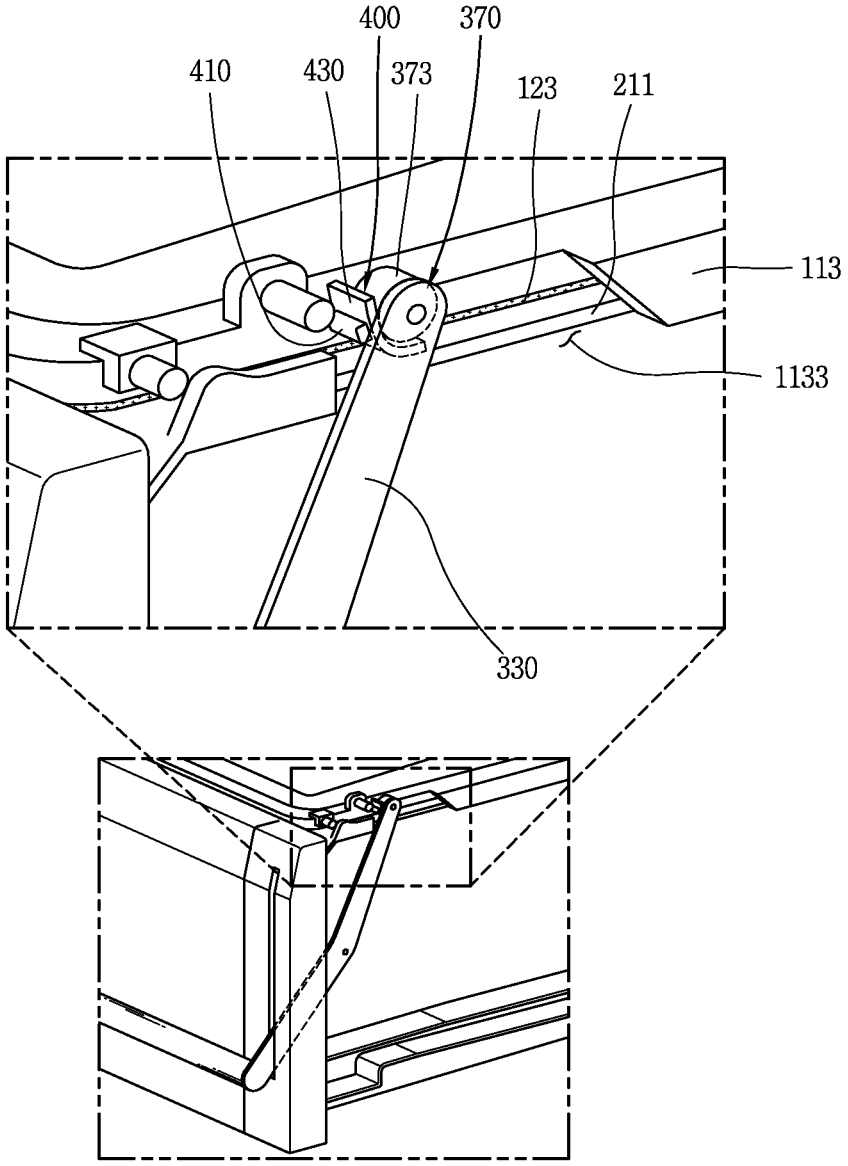
FIG. 6 is a partially enlarged view of a pressing unit in accordance with the one exemplary embodiment.
Figure 7:
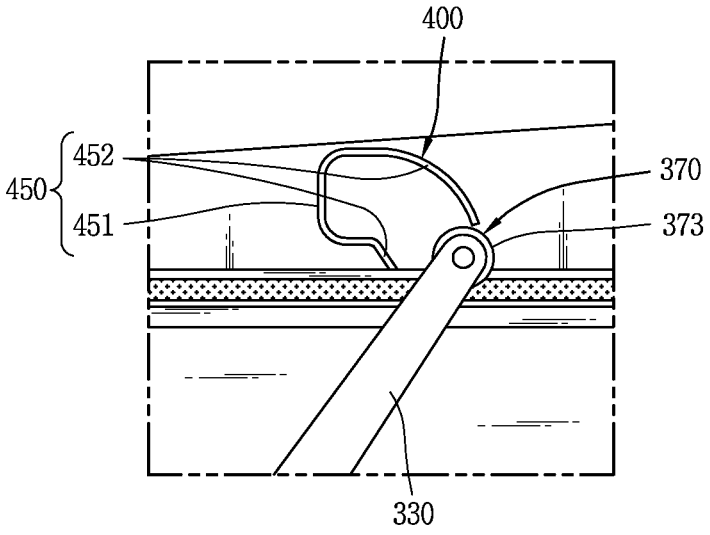
FIG. 7 is an enlarged view of a pressing unit in accordance with another exemplary embodiment.
Figure 8:
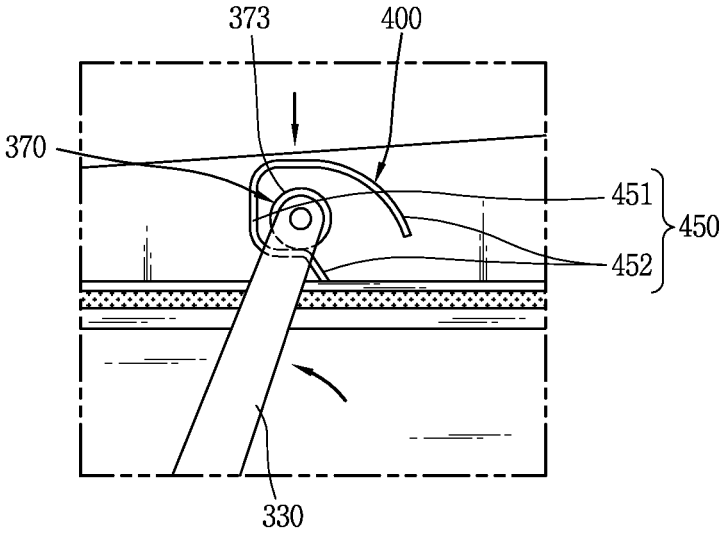
FIG. 8 is an operation state view of the pressing unit shown in FIG. 7.
Figure 9:
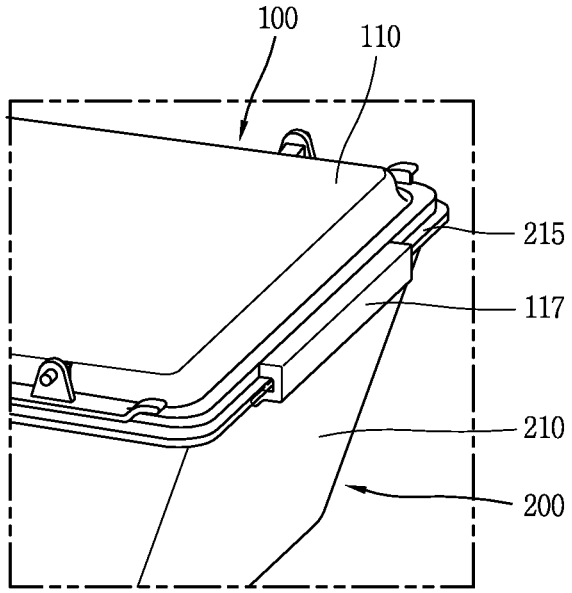
FIG. 9 is a perspective view of a vegetable storage container for a refrigerator in accordance with another exemplary embodiment.
Figure 10:
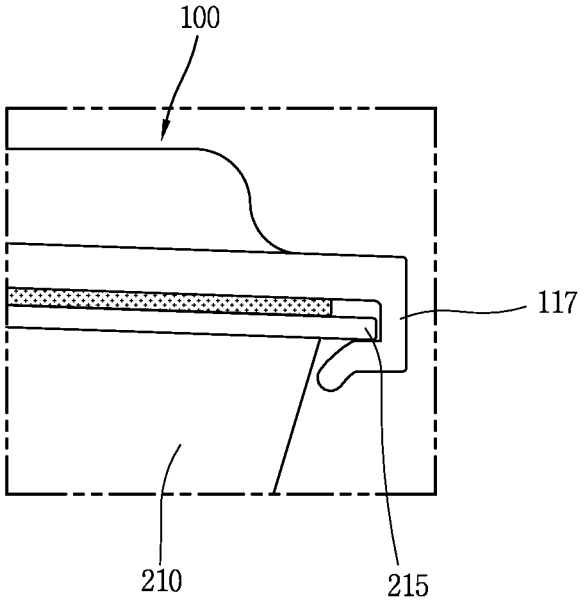
FIG. 10 is a side view of the exemplary embodiment shown in FIG. 9.

Hereinafter, description will be given in detail of a vegetable container for a refrigerator according to the exemplary embodiments with reference to FIGS. 4 to 9. FIG. 4 is a perspective view of a vegetable storage container for a refrigerator in accordance with one exemplary embodiment of the present disclosure, FIG. 5 is a perspective view showing a lever in accordance with the one exemplary embodiment, FIG. 6 is a partially enlarged view of a pressing unit in accordance with the one exemplary embodiment, FIG. 7 is an enlarged view of a pressing unit in accordance with another exemplary embodiment, FIG. 8 is an operation state view of the pressing unit shown in FIG. 7, FIG. 9 is a perspective view of a vegetable storage container for a refrigerator in accordance with another exemplary embodiment, and FIG. 10 is a side view of the exemplary embodiment shown in FIG. 9.

Referring to FIG. 4, one exemplary embodiment according to the present disclosure may provide a refrigerator with a vegetable storage container. The vegetable storage container may include a vegetable box 200 having a front part 230 and a main body 210 to define an accommodation space as a vegetable storage space therein, and installed to be drawn out of the refrigerator, a vegetable box cover 100 horizontally installed on the accommodation space to selectively cover an upper opening of the vegetable box 200, and a pressing unit 300, 400 to seal the accommodation space of the vegetable box 200 from the exterior in a vacuum state after the accommodation space of the vegetable box 200 is closed by the cover 100.

The refrigerator with the vegetable storage container may be any refrigerator in which a plurality of storage spaces are formed and the vegetable storage container is installed to be drawn out. The plurality of storage spaces of the refrigerator may typically be partitioned by a plurality of barrier walls, and may further be provided with a shielding film for preventing a loss of cold air. The configuration of the refrigerator is well known in the related art, so detailed description thereof will be omitted.

The one exemplary embodiment of the present disclosure may include gaskets 123 for shielding between the vegetable box cover 100 and the upper opening of the vegetable box 200, and a pressing unit 300, 400 for improving a sealing force of the gaskets 123. The cover 100 and the vegetable box 200 have fully described in the related art, so detailed description thereof will be omitted.

Here, the vegetable box cover 100 may be implemented as a member which is divided into an outer cover 110 and an inner cover 120, or as one integrated cover member.

The pressing unit may include a lever 300 installed to protrude to the front part 230 of the vegetable box 200 so as to press the vegetable box 100 in response to a user's manipulation, and pressing portions 400 installed on both side portions of the vegetable box cover 100 to seal the accommodation space in cooperation with the lever 300 after the vegetable box cover 100 is closed.

After the accommodation space is closed, pressure applied to the gaskets 123 by the weight of the cover 100 may not be enough to seal the space. Therefore, the pressing unit 300, 400 may further be separately provided to press each other by a user's manipulation.

The pressing unit may be implemented as various members. The present disclosure may employ any structure which is capable of pressing the vegetable box cover onto the upper surface of the main body for improving the sealing force by the weight of the vegetable box cover.

The pressing unit may include the lever 300 as a member with great rigidity, and pressing portions 400 engaged with end portions of the lever 300 to press the vegetable box cover 100.

Referring to FIGS. 4 and 5, the lever 300 may include a handle 310 installed with being spaced apart from the front part 230 and gripped by a user, supports 330 supporting the handle 310 and rotatable based on hinges, and pressing protrusions 370 protruding from end portions of the respective supports 330 in a lateral direction.

Although the lever 300 is shown in FIGS. 4 and 5, having a shape that the cylindrical handle 310 extends in a horizontal direction and the supports 330 extend from both ends of the handle 310 along side surfaces of the vegetable box 200. However, the present invention may employ any shape, such as a straight type or a T-like type, that a lever, which includes a handle protruding from the front part 230 of the main body so as for the user to grip it, and supports extending from the handle, can be engaged with the pressing portions to press the cover.

FIGS. 4 and 5 show the one exemplary embodiment that the middle portion of the lever 300 forms the handle 310, and the supports 330 of the lever 300 are almost perpendicularly bent from both ends of the handle 310.

Referring to FIG. 4, the handle 310 may have a shape of a round bar facilitating for the user's gripping and be spaced apart from the front part 230 of the main body in parallel in a horizontal direction.

The supports 330 may backwardly extend from both ends of the handle 310 and a middle portion of each support 330 may be slightly bent. A lever hinge portion 350 may be formed on the bent middle portion of each support 330. The handle 310 may be formed on the front end portions of the supports 330 and pressing protrusions 370 may protrude from rear end portions of the respective supports 330 in a lateral direction. The supports 330 may be rotatable based on the lever hinge portions 350.

The lever hinge portions 350 may be fixed to the vegetable box 200 by hinges. As shown in FIG. 4, as the handle 310 is manipulated up and down at the front part 230 of the vegetable box 200, the supports 330 may be rotated based on the lever hinge portions 350. Accordingly, the lever hinge portions 350 may be formed as a protrusion shaft or a hinge opening, and fabricated in a shape corresponding to a main body hinge portion 2335 of the vegetable box 200 to be explained later.

The pressing protrusions 370, as shown in FIGS. 4 and 5, may protrude from the rear end portions of the respective supports 330 in the lateral direction. The pressing protrusions 370 may press the vegetable box cover 100 onto the vegetable box 200 by interworking with the pressing portions 400 in a contacting manner, thereby improving a sealing force. Accordingly, the pressing protrusions 370 may preferably be formed of a smooth material and protrude into a cylindrical shape so as to minimize a frictional force upon coming in contact with the pressing portions 400.

In addition, each of the pressing protrusions 370 may include a pressing roller 373 to press the pressing portion 400 by being rolled on the pressing portion 400. The pressing roller 373 may be rolled on the pressing portion 400 when pressing the pressing portion 400, thereby minimizing a frictional force. This may allow the user to manipulate the handle 310 with a small force, more facilitating for improvement of the sealing force.

The front part 230 of the vegetable box 200 may include slots 2333 cut in a lengthwise direction thereof. The supports 330 may be inserted through the slots 2333 to be located on both outer sides of the main body 210 of the vegetable box 200. That is, the front part 230 may be fabricated as an integrated member.

The slots 2333 may be cut long in a vertical direction such that the handle 310 can be manipulated up and down at the front part 230 of the vegetable box 200. The slot 2333 may be provided in one or in plurality in number depending on the shape of the lever 300. For example, the lever 300 may include two supports 330 on both end portions of the handle 310, and two slots 2333 may be provided at both side portions of the front part 230.

Still referring to FIG. 4, as another example, the front part 230 of the vegetable box 200 may include a front panel 231 located at the front of the accommodation space, and side frames 233 formed on both sides of the front panel 231 and having slots 233 cut in the lengthwise direction thereof. The supports 330 may be inserted through the slots 2333 to be located on the outer sides of the main body 210 of the vegetable box 200.

The front panel 231 may be a plastic panel member constructing the front part 230 of the vegetable box 200. The front panel 231 may be provided with a separate handle by which the user can draw the vegetable box 200 out of the refrigerator. The front panel 231 may be implemented as a panel recessed in a vertical direction.

The side frames 233 may be separate members which are integrally coupled to both sides of the front panel 231. The side frame 233 may be a plastic member formed in a vertical direction and include the slots 2333 cut in the vertical direction. The supports 330 of the lever 300 may be inserted into the slots 2333 formed through the side frames 233 to be perpendicularly rotatable on a hinge basis.

The front part 230 may include main body hinge portions 2335 formed on both sides thereof to allow for rotation of the lever 300. The lever 300 may include the lever hinge portions 350 formed on the supports 330 and fixed to the main body hinge portions 2335 by hinges. Accordingly, the main body hinge portion 2335 and the lever hinge portion 350 may have shapes corresponding to each other in forms of hinge shaft and hinge opening or vice versa for mutual coupling therebetween. That is, when the main body hinge portion 2335 is formed in the form of protrusion, the lever hinge portion 350 may be the hinge opening in which the protrusion can be inserted. On the other hand, when the main body hinge portion 2335 is formed in the form of hinge opening, the lever hinge portion 350 may be the protrusion to be inserted into the hinge opening.

Here, when the front part 230 includes the side frames 233, the supports 330 may be inserted through the slots 2333 formed through the side frames 233. Therefore, the main body hinge portions 2335 may be formed on the side frames 233.

When the front part 230 includes the side frames 233, the supports 330 of the lever 300 may be inserted through the slots 2333 of the respective side frames 233 to be rotated on the hinge basis. Therefore, the main body hinge portions 2335 may be formed on the side frames 233, respectively.

Referring to FIG. 6, each of the pressing portions 400 may include a supporting shaft 410 protruding in a lateral direction of the vegetable box cover 100, and a plate 430 on which the pressing protrusion 370 is rolled based on the supporting shaft 410. The plate 430 may be curved upwardly. The supporting shaft 410 and the plate 430 may be formed integrally with each other or as separate members.

In accordance with the exemplary embodiment, the pressing protrusion 370 may protrude from the end portion of each support 330. Accordingly, when the user draws down the handle 310, the pressing protrusions 370 may be moved up in response to the hinge-rotation of the supports 330, thus to be rolled onto the pressing portions 400.

The supporting shaft 410, referring to FIG. 6, may protrude from a side portion of the front of the vegetable box cover 100 in the lateral direction. The supporting shaft 410 may be formed on the outer cover 110. The supporting shaft 410 may have a self-rotating structure such that the pressing protrusion 370 can be rolled upwardly.

However, when only the supporting shaft 410 is provided without the plate 430, there may be no need of a separate rotating structure if the pressing protrusion 370 can press the cover 100 by being stopped due to the supporting shaft 410.

The plate 430, still referring to FIG. 6, may have a shape of a plate whose upper surface is recessed, and allow the pressing protrusion 370 to be rolled onto the supporting shaft 410. Accordingly, the pressing protrusion 370 may first come in contact with the plate 430. When the user then presses down the handle 310 more strongly, the pressing protrusion 370 may be rolled onto the supporting shaft 410 with contacting the curved plate 430.

After the pressing protrusion 370 rolled onto the pressing portion 400 comes in contact with the curved plate 430, the plate 430 may be rotated based on the supporting shaft 410 and the pressing protrusion 370 may be rolled up toward a top of the supporting shaft 410. Accordingly, the pressing protrusion 370 may press down the supporting shaft 410, which integrally protrudes from the cover 100. This may allow the vegetable cover box 100 to be closely adhered onto the main body 210 of the vegetable box 200, thereby improving the sealing force.

As another example of the present invention, referring to FIG. 7, the pressing portion 400 may include a tilt rail 450 formed on each side portion of the vegetable box cover 100 in an inclined direction and allowing the pressing protrusion 370 of the lever 300 to be inserted therein.

The tilt rail 450, as shown in FIG. 7, may include guide ribs 452 whose each lower side is inclined from a front side toward a rear side, and a restriction rib 451 extending from the guide ribs 452 in a vertical direction. The guide ribs 452 may serve as a guiding portion for guiding the insertion of the pressing protrusion 370. The restriction rib 451 may serve to prevent the pressing protrusion 370 from being fallen down to the front side after rolled up along the guide ribs 452 of the tilt rail 450.

In accordance with the exemplary embodiment, referring to FIG. 8, when the user draws down the handle 310, the pressing protrusions 370 protruding from the end portions of the supports 330 may be moved up in response to the hinge-rotation of the supports 330, thereby being inserted into the pressing portions 400.

The pressing protrusions 370 may be rolled along the tilt rails 450 through the guide ribs 452 which are inclined downwardly at the lower side of the tilt rail 450 and then press down the tilt rail 450. Accordingly, the vegetable box cover 100 may be adhered onto the main body 210 more firmly, thereby enhancing the sealing structure.

Referring back to FIG. 6, the vegetable box cover 100 may include pressing protrusion insertion portions 1133 in each of which the pressing protrusion 370 is placed onto the pressing portion 400. Preferably, the pressing portion 400 may be formed on the side portion of the front of the outer cover 110, and the pressing protrusion insertion portion 1133 may also be formed by cutting off the pressing portion 400 by a predetermined length such that the pressing protrusion 370 can be placed onto the pressing portion 400 formed on the side portion of the outer cover 110.

An operational relation of those components according to the present disclosure will now be described with reference to FIG. 4. When the user draws down the handle 310, the supports 330 may be rotated based on the lever hinge portions 350, and the pressing protrusions 370 may be rolled onto the pressing portions 400 formed on the cover 100. The pressing protrusions 370 rolled on the pressing portions 400 may press down the cover 100 by interworking with the pressing portions 400. This may increase a pressing force of the cover gaskets 123 and the main body gaskets 213, thereby increasing the sealing force.

Also, when the pressing protrusion 370 is formed in the form of a pressing roller 373, the pressing protrusion 370 may be rolled onto the pressing portion 400 formed on the cover 100, so as to press the vegetable box cover 100 with minimizing a frictional force, thereby more easily enhancing the sealing force.

In accordance with another exemplary embodiment of the present disclosure, with reference to FIGS. 9 and 10, the vegetable box cover 100 may include a rear sealing support portion 117 formed in a bending manner, and the vegetable box main body 210 may include a protrusion rib 215 protruding backwardly such that the rear sealing support portion 117 can be fixed thereto.

The rear sealing support portion 117, as shown in FIGS. 9 and 10, may be bent from the rear of the vegetable box 200 to the rear of the vegetable box cover 100 in a shape like "⊃." Accordingly, the protrusion rib 215, which protrudes long toward the rear of the main body 210 of the vegetable box 200, can be inserted into the recessed portion of the rear sealing support portion 117 to be stopped therein.

Consequently, the pressing unit 300, 400 according to the present disclosure may press the front of the vegetable box 200 so as to enhance a sealing force. Also, the rear side of the vegetable box 200 may be fixed as the protrusion rib 215 is stopped in the rear sealing support portion 117, thereby enhancing the overall sealing force.

In accordance with the another exemplary embodiment, the vegetable box cover 100 may include an inner cover 120 having gaskets 123 for sealing the accommodation space, and an outer cover 110 located on the inner cover 120. The pressing unit 400 may press the outer cover 110.

The rear sealing support portion 117 may be bent downwardly from the rear side of the outer cover 110. The pressing portion 400 may press down the outer cover 110 from an upper surface of the vegetable box main body 210.

Also, the pressing portion 400 may be installed on the side portion of the outer cover 110 may seal the accommodation space in a vacuum state by interworking with the lever 300 after the outer cover 110 coupled to the inner cover 120 is closed.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A storage container for a refrigerator comprising:

a box comprising a front part and a main body together forming an accommodation space for storage, the box being installed to be drawn in and out of the refrigerator;

a cover horizontally installed to selectively cover an upper opening of the box; and a pressing unit to seal the accommodation space when the upper opening is covered by the cover, wherein the pressing unit comprises:

a pressing portion provided at a side portion of the cover; and a lever installed to protrude from the front part of the box to press the pressing portion and move the box and the cover closer together, wherein the lever comprises a pressing protrusion protruding from one end portion of the lever in an orthogonal direction, wherein the pressing portion comprises a tilt rail formed on the side portion of the cover in an inclined direction, and wherein the pressing protrusion of the lever is configured to be inserted into the tilt rail when the lever is manipulated.

2. The storage container of claim 1, wherein tilt rail comprises;

guide ribs whose each lower side is inclined upwardly at one side; and a restriction rib extending from the guide ribs in a vertical direction.

3. The storage container of claim 1, wherein the lever further comprises:

a handle; and a support supporting the handle and rotatable on a hinge.

4. The storage container of claim 3, wherein the front part of the box comprises a slot, wherein the support is inserted through the slot to be located on an outer side of the main body of the box.

5. The storage container of claim 4, wherein the front part of the box comprises:

a front panel located at a front of the accommodation space; and a plurality of side frames formed on a plurality of sides of the front panel, and having a slot, wherein the support is inserted through the slot to be located on an outer side of the main body.

6. The storage container of claim 3, wherein the box comprises a main body hinge portion formed on a side of the box to allow for hinge-based rotation of the lever, and wherein the lever comprises a lever hinge portion formed on the support and fixed to the main body hinge portion.

7. The storage container of claim 1, wherein the cover comprises a pressing protrusion insertion portion through which the pressing protrusion is inserted in the pressing portion.

8. The storage container of claim 1, wherein the pressing protrusion comprises a pressing roller on the pressing portion formed on the cover to press the pressing portion.

9. The storage container of claim 1, wherein the cover comprises a rear sealing support portion in a bent form, and wherein the main body comprises a protrusion rib protruding backwardly such that the rear sealing support portion engages the protrusion rib when the box is drawn into the refrigerator.

10. The storage container of claim 1, wherein the cover comprises:

an inner cover having a gasket to seal the accommodation space; and is an outer cover located on the inner cover, wherein the pressing unit presses the outer cover.

11. The storage container of claim 10, wherein the lever presses the outer cover, and wherein the pressing portion is installed on a side of the outer cover to seal the accommodation space by interworking with the lever after the cover is installed.

12. The storage container of claim 11, wherein the lever comprises:

a handle protruding from the front part of the box; and a support supporting the handle and rotatable on a hinge, wherein the pressing protrusion protrudes from an end portion of the support in an orthogonal direction.

13. The storage container of claim 11, wherein the outer cover comprises a rear sealing support portion in a bent form, and wherein the main body comprises a protrusion rib protruding backwardly such that the rear sealing support portion engages the protrusion rib when the box is drawn into the refrigerator.

14. The storage container of claim 13, wherein the rear sealing support portion is bent by protruding in a lateral direction.

15. A refrigerator including the storage container of claim 1.

* * * * *